US009381541B2

(12) United States Patent
Deniau et al.

(10) Patent No.: US 9,381,541 B2
(45) Date of Patent: Jul. 5, 2016

(54) METHOD FOR MODIFYING THE SURFACE ENERGY OF A SOLID

(75) Inventors: Guy Deniau, Auffargis (FR); Fabien Nekelson, Paris (FR); Brigitte Mouanda, Arnoult-en-Yvelines (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 1255 days.

(21) Appl. No.: 13/262,559

(22) PCT Filed: Apr. 2, 2010

(86) PCT No.: PCT/EP2010/054473

§ 371 (c)(1),
(2), (4) Date: Mar. 30, 2012

(87) PCT Pub. No.: WO2010/112610

PCT Pub. Date: Oct. 7, 2010

(65) Prior Publication Data

US 2012/0196035 A1 Aug. 2, 2012

(30) Foreign Application Priority Data

Apr. 2, 2009 (FR) ..... 09 52147

(51) Int. Cl.

| | |
|---|---|
| ***B05D 1/34*** | (2006.01) |
| ***B05D 5/08*** | (2006.01) |
| *B05D 3/00* | (2006.01) |
| *B05D 3/10* | (2006.01) |

(52) U.S. Cl.

CPC *B05D 1/34* (2013.01); *B05D 5/083* (2013.01); *B05D 3/007* (2013.01); *B05D 3/104* (2013.01); *B05D 2203/35* (2013.01)

(58) Field of Classification Search

CPC ..... C03C 17/30

See application file for complete search history.

(56) References Cited

U.S. PATENT DOCUMENTS

| | | | | |
|---|---|---|---|---|
| 2007/0262449 | A1* | 11/2007 | Bispo et al. | 257/753 |
| 2008/0145706 | A1* | 6/2008 | Mevellec et al. | 428/704 |
| 2011/0281441 | A1 | 11/2011 | Charlier et al. | |

FOREIGN PATENT DOCUMENTS

| | | | |
|---|---|---|---|
| FR | 2 897 876 | A1 | 8/2007 |
| FR | 2 921 516 | A1 | 3/2009 |

(Continued)

OTHER PUBLICATIONS

Mevellec V et al., "Grafting polymers on surfaces: A new powerful and versatile diazonium salt-based one-step process in aqueous media", Chemistry of Materials, 2007, vol. 19, pp. 6323-6330.

(Continued)

*Primary Examiner* — Alex A Rolland

(74) *Attorney, Agent, or Firm* — Knobbe, Martens, Olson & Bear, LLP

(57) ABSTRACT

A method for modifying the surface energy of at least one surface of a solid is provided. The method may comprise a step consisting of grafting, on the surface, a polymeric organic film consisting of graft polymers, each polymer having a first unit bound directly to the surface derived from a cleavable aryl salt and at least one other unit of the polymer chain derived from a component selected from the group consisting of a cleavable fluorinated aryl salt, a fluorinated (meth)acrylate and a vinyl-terminated siloxane. In addition, a kit for implementation of the method is provided.

18 Claims, 5 Drawing Sheets

(56) References Cited

FOREIGN PATENT DOCUMENTS

| | | | |
|---|---|---|---|
| WO | 03/080748 | A | 10/2003 |
| WO | 2008/078052 | A2 | 7/2008 |

OTHER PUBLICATIONS

International Search Report and Written Opinion issued for International Application No. PCT/EP2010/054473.

Lyskawa, et al., "Direct Modification of a Gold Electrode with Aminophenyl Groups by Electrochemical Reduction of in Situ Generated Aminophenyl Monodiazonium Cations", Chemical Mater., 2006, vol. 18, No. 20, pp. 4755-4763.

De Gennes, "Wetting: statics and dynamics", Rev. Mod. Phys., vol. 57, No. 3, Part I, Jul. 1985, pp. 827-863.

Rempp, et al., "Polymer Synthesis", 1991, 65-91, Huthig & Wepf.

Search Report issued on Jan. 12, 2010 for French Application No. 0952147.

* cited by examiner

METHOD FOR MODIFYING THE SURFACE ENERGY OF A SOLID

RELATED APPLICATIONS

This application is a U.S. National Phase of International Application No. PCT/EP2010/054473, filed Apr. 2, 2010, designating the U.S., and published in French as WO 2011/112610 on Oct. 7, 2011 which claims the benefit of French Patent Application No. 09 52147 filed Apr. 2, 2009.

TECHNICAL FIELD

The invention relates to the area of surface treatments.

More particularly, the present invention aims to provide a method for permanent treatment of a material for modifying the surface energy or interfacial tension of at least one of its surfaces and notably for modifying the wettability of this surface. The invention notably allows modification of the interfacial properties between a solid and a liquid.

The present invention proposes a method for increasing the contact angle of said surface by grafting a coating and also proposes a kit for implementation of such a method.

BACKGROUND

A surface is generally defined as the external portion or limit of a body; the surface is often regarded as an interface between the solid body and its environment whether it is notably solid, liquid or gaseous.

When a drop of a given liquid is deposited on the surface of a solid, it adopts an equilibrium configuration and spreads over the surface to a varying extent. The angle θ, or contact angle, which is defined as the angle measured between the surface of the solid and the tangent to the drop, results from the equilibrium of the tensions of the three interfaces solid/liquid, solid/vapor and liquid/vapor. These quantities are related to one another by Young's equation. Typically, a set of measurements is performed on one and the same surface to determine a mean value of θ. Four cases can be distinguished, depending on the value obtained:

- the liquid spreads spontaneously and wetting is said to be "perfect" ($\theta=0$),
- wetting is regarded as "good" ($0<\theta<90°$),
- wetting is said to be "poor" ($90°<\theta<180°$),
- no wetting occurs ($\theta=180°$).

The behaviors associated with the observations made at the macroscopic scale during measurements of contact angle may be different from those observed at smaller scales for which surface tensions of liquids play an important role. However, these behaviors do not detract from the value of the measurements performed on the macroscopic scale, as they make it possible to characterize the surfaces.

The characterization and investigation of the properties and of the behavior of the surfaces are abundantly documented in the literature, to which a person skilled in the art can refer. In this connection, we may notably mention the article by P. G. de Gennes, 1985 (Rev. Mod. Phys., vol. 57, pages 827-863).

The wettability of a surface can be altered by impregnation with a compound that penetrates more or less deeply into the material of which the structure is composed. This type of treatment requires the existence of affinity between the surface treated and the impregnating compound. However, the surface obtained is rarely homogeneous. Moreover, as the impregnating compound remains labile, the treatment must be repeated regularly to ensure its durability. The application of wax on wood corresponds to this type of treatment.

The application of a coating also leads to modification of the surface properties. Generally this type of treatment is applied to reduce the wettability of the surface with respect to water and increase the contact angle. The coating typically corresponds to a resin. The basic products used can be epoxy resins, polyurethanes, polyesters, or vinyl resins, associated with specific properties. The application of these compounds does not lead to the formation of strong bonds at the interface of the surface and the coating, which thus reduces the service life of this type of coating, depending on the environment. Moreover, they are generally films having a considerable thickness, notably greater than a micron, especially when the coating is applied to large areas of the order of several $m^2$. At this thickness, there is a difference in optical properties between the untreated material and the material covered with the coating.

Glass is a material for which surface treatments are used extensively. At present, the surface tension of glass is only controlled by grafting alkyl siloxanes, of which there is a wide choice. However, the problem with this type of grafting is the stability of the bond between the glass and the silane (—Si—O—Si— bond), which soon undergoes hydrolysis, notably in a humid environment. This bond is fragile, depending on the environment, and especially in a basic environment.

There is therefore a real need to provide a durable treatment for modifying and/or controlling the surface tension of a material, applicable to any material and not altering the optical properties of said material thus treated.

DESCRIPTION OF CERTAIN INVENTIVE ASPECTS

The present invention makes it possible to solve the aforementioned technical problems and drawbacks. Thus, the present inventors studied the grafting of an organic coating on the surface of a material to modify its properties such as surface energy, also called "surface tension", "interfacial energy" or "interfacial tension".

Grafting of such an organic coating permits stable covalent bonds to be formed between the surface of the material and said organic coating and is applicable to any type of material and notably to glass. The establishment of covalent bonds between the material and the coating ensures the stability of the pair and contributes to the durability of the treatment.

The thickness of the organic coating obtained by this grafting is, moreover, easily controllable. Thus, the coating can be in the form of very thin films that do not alter the optical properties of the material.

The surface to be coated can be of an insulating, conducting or semiconducting material notably when the grafting technique employed is chemical or radical grafting. Moreover, said grafting can be performed in an aqueous medium such as in an organic medium. For these reasons, the method according to the invention is applicable to any type of surface.

Finally, the chemical diversity of the structural units employed during said grafting makes it possible to cover and obtain a wide range of surface tensions.

Thus, the present invention relates to a method for modifying the surface energy of at least one surface of a solid comprising a step consisting of grafting, on said surface, a polymeric organic film, the first unit of which is derived from an adhesion primer and of which at least one other unit is derived from a component selected from the group consisting of a fluorinated adhesion primer, a fluorinated (meth)acrylate and a vinyl-terminated siloxane.

More particularly, the present invention relates to a method for modifying the surface energy of at least one surface of a solid comprising a step consisting of grafting, on said surface, a polymeric organic film consisting of graft polymers, each polymer having a first unit directly bound to said surface derived from a cleavable aryl salt and at least one other unit of the polymer chain derived from a component selected from the group consisting of a cleavable fluorinated aryl salt, a fluorinated (meth)acrylate and a vinyl-terminated siloxane.

"Modify the surface energy" means, in the context of the present invention, both increase and decrease the surface energy (or "interfacial energy") notably with respect to a given liquid, whether it is hydrophilic or hydrophobic. The method according to the present invention makes it possible to modify (i.e. increase or decrease) the contact angle of a liquid disposed on the surface thus treated relative to the contact angle of the same liquid disposed on said untreated surface. Advantageously, the method according to the present invention is a method that makes it possible to modify (i.e. increase or decrease) the wettability of said surface.

"Adhesion primer" means, in the context of the present invention, any organic molecule that is able, under certain nonelectrochemical or electrochemical conditions, to form either radicals, or ions, and particularly cations, and thus participate in chemical reactions. Said chemical reactions can notably be chemisorption and in particular chemical grafting or electrografting. Thus, such an adhesion primer is capable, under nonelectrochemical or electrochemical conditions, of being chemisorbed on the surface, notably by a radical reaction, and of having another function that is reactive with respect to another radical after this chemisorption.

The adhesion primer is a cleavable aryl salt. Thus, all references in the present text to an adhesion primer also apply to the cleavable aryl salt. The cleavable aryl salt is advantageously selected from the group consisting of aryldiazonium salts, arylammonium salts, arylphosphonium salts, aryliodonium salts and arylsulfonium salts. In these salts, the aryl group is an aryl group that can be represented by R as defined below.

Among the cleavable aryl salts, we may in particular mention the compounds of the following formula (I):

$$R—N^{2+},A^- \quad (I)$$

in which:

A represents a monovalent anion and

R represents an aryl group.

As aryl group of the cleavable aryl salts and notably of the compounds of formula (I) above, we may advantageously mention the aromatic or heteroaromatic carbon-containing structures, optionally mono- or polysubstituted, consisting of one or more aromatic or heteroaromatic rings each having from 3 to 8 atoms, wherein the heteroatom or heteroatoms can be N, O, P or S. The substituent or substituents can contain one or more heteroatoms, such as N, O, F, Cl, P, Si, Br or S as well as notably C1-C6 alkyl groups or C4-C12 thioalkyl groups.

Within the cleavable aryl salts and notably the compounds of formula (I) above, R is preferably selected from the aryl groups substituted with electron-attracting groups such as $NO_2$, ketones, CN, $CO_2H$, and esters. The groups R of the aryl type that are particularly preferred are benzene and nitrobenzene radicals, optionally substituted.

Within the compounds of formula (I) above, A can notably be selected from inorganic anions such as halides such as $I^-$, $Br^-$ and $Cl^-$, haloborates such as tetrafluoroborate, perchlorates and sulfonates and organic anions such as alcoholates and carboxylates.

As compounds of formula (I), it is particularly advantageous to use a compound selected from the group consisting of 4-nitrobenzenediazonium tetrafluoroborate, tridecylfluorooctylsulfamylbenzene diazonium tetrafluoroborate, phenyldiazonium tetrafluoroborate, 4-nitrophenyldiazonium tetrafluoroborate, 4-bromophenyldiazonium tetrafluoroborate, 4-aminophenyldiazonium chloride, 2-methyl-4-chlorophenyldiazonium chloride, 4-benzoylbenzenediazonium tetrafluoroborate, 4-cyanophenyldiazonium tetrafluoroborate, 4-carboxyphenyldiazonium tetrafluoroborate, 4-acetamidophenyldiazonium tetrafluoroborate, 4-phenylacetic acid diazonium tetrafluoroborate, 2-methyl-4-[(2-methylphenyl) diazenyl]benzenediazonium sulfate, 9,10-dioxo-9,10-dihydro-1-anthracenediazonium chloride, 4-nitronaphthalenediazonium tetrafluoroborate and naphthalenediazonium tetrafluoroborate.

"Fluorinated adhesion primer" means, in the context of the present invention, an adhesion primer as previously described comprising at least one fluorine atom, notably comprising between 1 and 40 fluorine atoms, in particular between 5 and 30 fluorine atoms and, more particularly, between 10 and 20 fluorine atoms. The fluorinated adhesion primer is a cleavable fluorinated aryl salt. Advantageously, said cleavable fluorinated aryl salt is selected from the group consisting of fluorinated aryldiazonium salts, fluorinated arylammonium salts, fluorinated arylphosphonium salts, fluorinated aryliodonium salts and fluorinated arylsulfonium salts. In these salts, the fluorinated aryl group is a fluorinated aryl group that can be represented by R' as defined below.

Among the cleavable fluorinated aryl salts, we may in particular mention the compounds of the following formula (II'):

$$R'—N^{2+},A^- \quad (II')$$

in which:

A represents a monovalent anion as defined above and

R' represents a fluorinated aryl group.

As fluorinated aryl group of the cleavable fluorinated aryl salts and notably of the compounds of formula (II) described above, we may mention aromatic or heteroaromatic carbon-containing structures, optionally mono- or polysubstituted, consisting of one or more aromatic or heteroaromatic rings each having from 3 to 8 atoms, wherein the heteroatom or heteroatoms can be N, O, P or S and the substituent or substituents are C1-C18, and more particularly C5-C12, alkyl groups or C4-C12 thioalkyl groups, the alkyl and thioalkyl groups comprising one or more fluorine atoms. The alkyl or thioalkyl substituent or substituents can comprise between 1 and 40 fluorine atoms, notably between 5 and 30 fluorine atoms and, in particular, between 10 and 20 fluorine atoms.

"Fluorinated (meth)acrylate" means, in the context of the present invention, a compound of formula (III):

$$CH_2{=}C(R_1)—C(O)O—R_2 \quad (III)$$

in which $R_1$ represents a hydrogen atom or a methyl group and $R_2$ represents an alkyl group, the methyl group and/or $R_2$ comprising at least one fluorine atom. This alkyl group is a linear, branched or cyclic alkyl group, preferably substituted with at least one fluorine atom and comprising from 1 to 20 carbon atoms, notably from 2 to 15 carbon atoms and, in particular, from 3 to 12 carbon atoms. Said alkyl group can comprise between 1 and 40 fluorine atoms, in particular between 2 and 30 fluorine atoms and, more particularly, between 5 and 20 fluorine atoms.

"Vinyl-terminated Siloxane" means, in the context of the present invention, a saturated hydride of silicon and of oxygen formed from linear or branched chains of alternating atoms of silicon and oxygen, bearing vinylic units. More particularly, in the context of the present invention, a vinyl-terminated siloxane is a compound of formula (IV):

$$R_3\text{-}[OSi(R_4)(R_5)]_n\text{—}R_6 \quad (IV)$$

in which n represents an integer between 2 and 200, notably between 5 and 150 and, in particular, between 10 and 100;

$R_3$ and $R_6$ are groups having at least one ethylenic unsaturation and $R_4$ and $R_5$, which may be identical or different, represent a linear, branched or cyclic alkyl group, comprising from 1 to 6 carbon atoms and notably from 1 to 3 carbon atoms.

Advantageously, $R_3$ represents a group —C(O)—$R_7$ and/or $R_6$ represents a group —O—C(O)—$R_8$ in which $R_7$ and $R_8$, which may be identical or different, represent a group comprising 2 to 12 carbon atoms and having at least one ethylenic unsaturation. More particularly, $R_7$ and $R_8$, which may be identical or different, correspond to groups of formula (V):

$$C(R_9)(R_{10})\text{=}C(R_{11})\text{—} \quad (V)$$

in which $R_9$, $R_{10}$ and $R_{11}$, which may be identical or different, represent a hydrogen atom or a linear, branched or cyclic alkyl group, comprising from 1 to 4 carbon atoms and notably 1 or 2 carbon atoms. More particularly, $R_9$ and $R_{10}$ represent a hydrogen atom and $R_{11}$ is either a hydrogen atom, or a methyl group.

The organic film implemented in the context of the present invention can be prepared starting from:

(i) one or a mixture of fluorinated adhesion primer(s) as defined above;

(ii) an advantageously nonfluorinated adhesion primer mixed with a component selected from the group comprising a fluorinated adhesion primer, a fluorinated (meth)acrylate and a vinyl-terminated siloxane as defined above;

(iii) an adhesion primer, advantageously nonfluorinated, mixed with several components selected from the group comprising fluorinated adhesion primers, fluorinated (meth)acrylates, vinyl-terminated siloxanes as defined above and mixtures thereof;

(iv) a mixture containing, in addition to the constituents envisaged in points (i), (ii) and (iii), one (or more) other chemical compound(s) such as polymerizable monomers and notably such as polymerizable monomers of formula (II) as defined in patent application FR 2 921 516.

Thus, the organic film employed in the context of the present invention is essentially polymeric or copolymeric, derived from several monomer units of identical or different chemical species and/or from molecules of the adhesion primer. The films obtained by the method of the present invention are "essentially" of the polymeric type insofar as the film also incorporates species derived from the adhesion primer and not only the monomers that are present. The organic film within the context of the invention and, more particularly, the polymers of which it is constituted have a sequence of monomer units in which the first unit is constituted by a derivative of the adhesion primer or is derived from an adhesion primer, the other units being derived or obtained indiscriminately from the fluorinated or nonfluorinated adhesion primers and/or from the polymerizable monomers and notably from the fluorinated (meth)acrylates and vinyl-terminated siloxanes as defined above. The units of the organic film starting from the second unit therefore result from, notably radical, polymerization of the components present, selected from fluorinated or nonfluorinated adhesion primers, fluorinated (meth)acrylates, vinyl-terminated siloxanes and polymerizable monomers such as the polymerizable monomers of formula (II) as defined in patent application FR 2 921 516.

In fact, it should be pointed out that the molecules of fluorinated or nonfluorinated adhesion primer can be described as polymerizable insofar as, by radical reaction, they can lead to the formation of molecules of relatively high molecular weight whose structure is formed essentially of units with multiple repetitions derived, in fact or from a conceptual standpoint, from molecules of the adhesion primer. In such a case, the organic film employed in the context of the present invention may consist solely of units derived or obtained from adhesion primers, which may be identical or different. More particularly, the polymers constituting the organic film may consist solely of units derived or obtained from adhesion primers, which may be identical or different.

In a first embodiment of the present invention, the grafting employed in the method is a chemical grafting.

The term "chemical grafting" refers notably to the use of extremely reactive molecular entities (typically radical entities) capable of forming bonds of the covalent bond type with a surface of interest, said molecular entities being generated independently of the surface on which they are intended to be grafted. Thus, the grafting reaction leads to the formation of covalent bonds between the region of the surface to be coated with an organic film and the derivative of the adhesion primer.

"Derivative of the adhesion primer" means, in the context of the present invention, a chemical unit resulting from the adhesion primer, after the latter has reacted with the surface, by chemical grafting, and optionally with another chemical compound, by radical reaction, said other chemical compound giving the second unit of the organic film. Thus, the first unit of the organic film (i.e. of the polymers of which it is constituted) is a derivative of the adhesion primer, which has reacted with the surface and with another chemical compound.

Advantageously, this first embodiment comprises the steps consisting in:

$a_1$) contacting said surface with a solution $S_1$ comprising at least one adhesion primer (i.e. at least one cleavable aryl salt) and at least one component selected from the group comprising a fluorinated adhesion primer (i.e. at least one cleavable fluorinated aryl salt), a fluorinated (meth)acrylate and a vinyl-terminated siloxane;

$b_1$) submitting said solution $S_1$ to nonelectrochemical conditions permitting the formation of radical entities from said adhesion primer (i.e. from said cleavable aryl salt).

Any surface, inorganic or organic, having one or more atom(s) or group(s) of atoms that can be involved in a reaction of addition or of radical substitution, such as CH, carbonyls (ketone, ester, acid, aldehyde), —OH, ethers, amines, halogens, such as F, Cl, Br, is notably covered by the present invention.

The surfaces of inorganic nature can notably be selected from conducting materials such as metals, noble metals, metal oxides, transition metals, metal alloys and for example Ni, Zn, Au, Pt, Ti or steel. They can also be semiconductor materials such as Si, SiC, AsGa, Ga, etc. It is also possible to apply the method to nonconducting surfaces such as nonconducting oxides such as $SiO_2$, $Al_2O_3$ and MgO. More generally, an inorganic surface can be constituted, for example, of an amorphous material, such as a glass generally containing silicates or a ceramic, as well as a crystalline material such as diamond, graphite which can be more or less organized, such as graphene, highly oriented graphite (HOPG), or carbon nanotubes.

As surface of organic nature, we may notably mention natural polymers such as latex or rubber, or artificial polymers such as derivatives of polyamide or of polyethylene, and notably polymers having bonds of the n type such as polymers bearing ethylene bonds, carbonyl groups, imine. It is also possible to apply the method to more complex organic surfaces such as leather, surfaces comprising polysaccharides, such as cellulose for wood or paper, artificial or natural fibers, such as cotton or felt, as well as fluorinated polymers such as polytetrafluoroethylene (PTFE) or to polymers bearing basic groups such as tertiary or secondary amines and for example pyridines, such as poly-4 and poly-2-vinylpyridines (P4VP and P2VP) or more generally polymers bearing aromatic and nitrated aromatic groups.

More particularly, the surface whose surface energy we wish to modify is a surface of glass such as a flat glass notably used in building, architecture, automobiles, glazing and the mirror industry, an aquarium glass, a glass for mechanical optics or an optical glass.

The solution $S_1$ can further comprise a solvent. The latter can be a protic solvent or an aprotic solvent. It is preferable for the adhesion primer that is used to be soluble in the solvent of solution $S_1$.

"Protic solvent" means, in the context of the present invention, a solvent that has at least one hydrogen atom that can be released in the form of a proton.

The protic solvent is advantageously selected from the group comprising water, deionized water, distilled water, acidified or not, acetic acid, hydroxylated solvents such as methanol and ethanol, liquid glycols of low molecular weight such as ethylene glycol, and mixtures thereof. In a first variant, the protic solvent used in the context of the present invention is only constituted of a protic solvent or a mixture of different protic solvents. In another variant, the protic solvent or the mixture of protic solvents can be used mixed with at least one aprotic solvent, provided the resultant mixture has the characteristics of a protic solvent.

"Aprotic solvent" means, in the context of the present invention, a solvent which is not regarded as protic. Such solvents are not able to release a proton or accept one in nonextreme conditions.

The aprotic solvent is advantageously selected from dimethylformamide (DMF), acetone, tetrahydrofuran (THF), dichloromethane, acetonitrile, dimethyl sulfoxide (DMSO) and mixtures thereof.

The solution $S_1$ comprising an adhesion primer and a component as defined above can moreover contain at least one surfactant, notably for improving the solubility of said component. A precise description of the surfactants usable within the context of the invention is given in patent application FR 2 897 876, to which a person skilled in the art will be able to refer. A single surfactant or a mixture of several surfactants can be used.

It is preferable for the adhesion primer to be soluble in the solvent of solution $S_1$. In the sense of the invention, an adhesion primer is considered to be soluble in a given solvent if it remains soluble up to a concentration of 0.5 M, i.e. its solubility is at least equal to 0.5 M at standard temperature and pressure (STP). Solubility is defined as the analytical composition of a saturated solution as a function of the proportion of a given solute in a given solvent; it can notably be expressed as molarity. A solvent containing a given concentration of a compound will be considered to be saturated when the concentration is equal to the solubility of the compound in this solvent. Solubility can be finite or infinite. In the latter case, the compound is soluble in all proportions in the solvent in question.

The amount of the adhesion primer present in the solution $S_1$ used according to the method of the invention can be varied as required by the experimenter. Said amount is notably related to the thickness of organic film desired as well as the amount of the adhesion primer that it is possible and conceivable to incorporate in the film. Thus, to obtain a film grafted on the whole of its surface in contact with the solution, it is necessary to use a minimum amount of the adhesion primer, which can be found by calculations of molecular dimensions. According to a particularly advantageous embodiment of the invention, the concentration of the adhesion primer in the liquid solution is between about $10^{-6}$ and 5 M, preferably between $10^{-3}$ and $10^{-1}$ M.

When the solvent is a protic solvent, and advantageously, in the case when the adhesion primer is an aryldiazonium salt, the pH of the solution is typically less than 7. It is recommended to work at a pH between 0 and 3 when preparing the adhesion primer in the same medium as that for grafting. If necessary, the pH of the solution can be adjusted to the desired value by means of one or more acidifying agents that are well known to a person skilled in the art, for example using mineral or organic acids such as hydrochloric acid, sulfuric acid, etc.

The adhesion primer can either be introduced as it is in solution $S_1$ as defined above, or can be prepared in situ in the latter. Thus, in a particular embodiment, the method according to the present invention comprises a step of preparation of the adhesion primer, notably when the latter is an aryldiazonium salt. Said compounds are generally prepared starting from arylamine, which can comprise several amine substituents, by reaction with $NaNO_2$ in acid medium. For a detailed account of the experimental conditions usable for said preparation in situ, a person skilled in the art can refer to the article by Belanger et al., 2006 (Chem. Mater., vol. 18, pages 4755-4763). Preferably, grafting will then be performed directly in the solution for preparing the aryldiazonium salt.

The components selected from the group comprising a fluorinated adhesion primer, a fluorinated (meth)acrylate and a viny-terminated siloxane and notably fluorinated (meth) acrylates and vinyl-terminated siloxanes can be soluble up to a certain proportion in the solvent of solution $S_1$, i.e. the value of their solubility in this solvent is finite. This applies to the other components that solution $S_1$ might also contain, such as the polymerizable monomers of formula (II) as defined in patent application FR 2 921 516. These components (fluorinated adhesion primers, fluorinated (meth)acrylates, vinyl-terminated siloxanes and others) can thus be selected from the compounds whose solubility in the solvent of solution $S_1$ is finite, notably less than 0.1 M, and in particular between $5.10^{-2}$ and $10^{-6}$ M. The invention also applies to a mixture of two, three, four or more components selected from the components described above.

The amount of these components in solution $S_1$ can vary as required by the experimenter. This amount can be greater than the solubility of the component in question in the solvent of solution $S_1$ used and can represent for example from 18 to 40 times the solubility of said component in the solution at a given temperature, generally room temperature or the reaction temperature. In these conditions, it is advantageous to use means for dispersing the molecules of monomer in the solution, such as a surfactant or ultrasounds.

The solution $S_1$ comprising an adhesion primer and a component selected from the group comprising a fluorinated adhesion primer, a fluorinated (meth)acrylate, a vinyl-terminated siloxane and optionally a polymerizable monomer of formula (II) as defined in patent application FR 2 921 516, can further contain at least one surfactant, notably to improve the solubility of said component. A precise description of surfactants usable within the context of the invention is given in patent application FR 2 897 876, to which a person skilled in the art can refer. A single surfactant or a mixture of several surfactants can be used. The solution $S_1$ can moreover be in the form of an emulsion.

"Non-electrochemical conditions", implemented in step ($b_1$) of the method according to the invention, means, in the context of the present invention, in the absence of voltage. Thus, the nonelectrochemical conditions employed in step ($b_1$) of the method according to the invention are conditions that permit the formation of radical entities from the adhesion primer, in the absence of application of any voltage on the surface on which the organic film is grafted. These conditions involve parameters such as, for example, temperature, nature of the solvent, presence of a particular additive, stirring, pressure, whereas electric current is not involved during formation of the radical entities. There are numerous nonelectrochemical conditions permitting the formation of radical entities, and this type of reaction is known and has been investigated in detail in the prior art (Rempp & Merrill, Polymer Synthesis, 1991, 65-86, Hüthig & Wepf).

It is thus possible, for example, to act upon the thermal, kinetic, chemical, photochemical or radiochemical environment of the adhesion primer in order to destabilize it so that it forms a radical entity. It is of course possible to act upon several of these parameters simultaneously.

In the context of the present invention, the nonelectrochemical conditions permitting the formation of radical entities are typically selected from the group comprising thermal, kinetic, chemical, photochemical, and radiochemical conditions and combinations thereof. Advantageously, the nonelectrochemical conditions are selected from the group comprising thermal, chemical, photochemical, and radiochemical conditions and combinations thereof with one another and/or with the kinetic conditions. The nonelectrochemical conditions employed in the context of the present invention are more particularly chemical conditions.

The thermal environment is a function of temperature. It is easily controlled with the heating means usually employed by a person skilled in the art. The use of a thermostatically controlled environment is of particular interest since it permits precise control of the reaction conditions.

The kinetic environment corresponds essentially to the system for agitation and to the frictional forces. This does not include the agitation of the molecules per se (bond lengthening etc.), but the overall motion of the molecules. The application of pressure notably makes it possible to supply energy to the system so that the adhesion primer is destabilized and can form reactive, notably radical, species.

Finally, the action of various forms of radiation such as electromagnetic radiation, γ radiation, UV radiation, electron or ion beams can also destabilize the adhesion primer sufficiently for it to form radicals and/or ions. The wavelength used will be selected in relation to the primer used. For example, a wavelength of about 306 nm will be used for 4-hexylbenzenediazonium.

Within the context of the chemical conditions, one or more chemical initiator(s) are used in the reaction mixture. The presence of chemical initiators is often linked to nonchemical environmental conditions, as outlined above. Typically, a chemical initiator will act on the adhesion primer and will generate the formation of radical entities from the latter. It is also possible to use chemical initiators whose action is not linked essentially to the environmental conditions and which can act over wide ranges of thermal or kinetic conditions. The initiator will preferably be suitable for the reaction environment, for example the solvent.

There are numerous chemical initiators. They are generally divided into three types depending on the environmental conditions used:

- thermal initiators, the commonest of which are peroxides or azo compounds. Under the action of heat, these compounds dissociate into free radicals. In this case, the reaction is carried out at a minimum temperature corresponding to that required for the formation of radicals from the initiator. Chemical initiators of this type are generally used specifically in a certain temperature range, as a function of their decomposition kinetics;
- photochemical or radiochemical initiators, which are excited by radiation triggered by irradiation (most often by UV, but also by γ radiation or by electron beams), permit the production of radicals by mechanisms of varying complexity. $Bu_3SnH$ and $I_2$ are photochemical or radiochemical initiators;
- essentially chemical initiators, initiators of this type act rapidly and at standard temperature and pressure on the adhesion primer to enable it to form radicals and/or ions. Such initiators generally have a redox potential that is less than the reduction potential of the adhesion primer used in the reaction conditions. Depending on the nature of the primer, it can thus be for example a reducing metal, such as iron, zinc, nickel; a metallocene such as ferrocene; an organic reducing agent such as hypophosphorous acid ($H_3PO_2$) or ascorbic acid; an organic or inorganic base in proportions sufficient to permit destabilization of the adhesion primer. Advantageously, the reducing metal used as chemical initiator is in finely divided form, such as metal wool or metal filings. Generally, when an organic or inorganic base is used as chemical initiator, a pH greater than or equal to 4 is generally sufficient. Structures of the radical reservoir type, such as polymer matrices previously irradiated with an electron beam or with a beam of heavy ions and/or by all of the means of irradiation mentioned above, can also be used as chemical initiators to destabilize the adhesion primer and notably to lead to the formation of radical entities from the latter.

It is useful to refer to the article by Mevellec et al., 2007 (Chem. Mater., vol. 19, pages 6323-6330) for the formation of active species.

In a second embodiment of the present invention, the grafting employed in the method is electrografting.

"Electrografting" means, in the context of the present invention, an electrically initiated, localized grafting technique of an adhesion primer that can be activated electrically, on a composite surface comprising portions that are electrically conducting and/or semiconducting, by bringing said adhesion primer into contact with said composite surface. In this method, grafting is performed electrochemically in a single step on defined, selected zones of said conducting and/or semiconducting portions. Said zones are raised to a potential greater than or equal to a threshold electric potential determined relative to a reference electrode, said threshold electric potential being the potential above which grafting of said adhesion primers occurs. Once said adhesion primers have been grafted, they possess another function that is reactive with respect to another radical and is able to engage radical polymerization that is independent of the electric potential.

Advantageously, this second embodiment comprises the steps consisting in:

$a_2$) bringing said conducting or semiconducting surface into contact with a solution $S_2$ comprising at least one adhesion primer (i.e. at least one cleavable aryl salt) and at least one component selected from the group comprising a fluorinated adhesion primer (i.e. at least one cleavable fluorinated aryl salt), a fluorinated (meth)acrylate and a vinyl-terminated siloxane;

$b_2$) polarizing said surface to an electric potential that is more cathodic than the reduction potential of the adhesion primer (i.e. at least one cleavable aryl salt) employed in step ($a_2$), steps ($a_2$) and ($b_2$) taking place in any order.

In the context of the present invention, "semiconductor" means an organic or inorganic material having an electrical conductivity that is intermediate between metals and insulators. The properties of conductivity of a semiconductor are mainly influenced by the charge carriers (electrons or holes) in the semiconductor. These properties are determined by two particular energy bands called the valence band (corresponding to the electrons involved in covalent bonds) and the conduction band (corresponding to electrons in an excited state and capable of moving in the semiconductor). The "gap" represents the energy difference between the valence band and the conduction band. A semiconductor also corresponds, in contrast to insulators or metals, to a material whose electrical conductivity can be controlled to a large extent by adding dopants, which correspond to impurities added to the semiconductor.

The surface implemented within the context of the method according to the invention can be any surface usually employed in electrografting and advantageously an inorganic surface. Said inorganic surface can notably be selected from conducting materials such as metals, noble metals, metal oxides, transition metals, metal alloys and for example Ni, Zn, Au, Ag, Cu, Pt, Ti and steel. The inorganic surface can also be selected from semiconductor materials such as Si, SiC, AsGa, Ga, etc.

Thus, said inorganic surface employed in the method according to the invention generally consists of a material selected from metals, noble metals, metal oxides, transition metals, metal alloys and photosensitive or nonphotosensitive semiconductor materials.

In the context of the present invention, "photosensitive semiconductor" means a semiconductor material whose conductivity can be modulated by variations of magnetic field, of temperature or of illumination, which have an influence on the electron-hole pairs and density of the charge carriers. These properties are due to the existence of the gap as defined previously. This gap generally does not exceed 3.5 eV for semiconductors, as opposed to 5 eV in materials regarded as insulators. It is thus possible to populate the conduction band by exciting the carriers across the gap, especially by illumination. The elements of group IV of the periodic table, such as carbon (in the form of diamond), silicon and germanium have such properties. The semiconductor materials may be formed from several elements, either from group IV, for instance SiGe or SiC, or from groups III and V, for instance GaAs, InP or GaN, or alternatively from groups II and VI, for instance CdTe or ZnSe.

Advantageously, in the context of the present invention, the photosensitive semiconducting substrate is of inorganic nature. Thus, the photosensitive semiconductor employed in the context of the present invention is selected from the group comprising elements of group IV (more particularly, silicon and germanium); alloys of elements of group IV (more particularly, the alloys SiGe and SiC); alloys of elements of group III and of group V (called "III-V" compounds, such as AsGa, InP, GaN) and alloys of elements of group II and of group VI (called "II-VI" compounds, such as CdSe, CdTe, $Cu_2S$, ZnS or ZnSe). The preferred photosensitive semiconductor is silicon.

In one embodiment of the present invention, it is possible for the photosensitive semiconductor to be doped with one (or more) dopant(s). The dopant is selected as a function of the semiconductor, and doping is of the p or n type. The choice of dopant and doping technologies are routine techniques for a person skilled in the art. More particularly, the dopant is selected from the group comprising boron, nitrogen, phosphorus, nickel, sulfur, antimony, arsenic and mixtures thereof. As examples, for a silicon substrate, among the commonest dopants of the p type, we may notably mention boron and, for dopants of the n type, arsenic, phosphorus and antimony.

If the surface employed in the context of the present invention is of a photosensitive semiconductor material, the method further comprises a step ($c_2$) consisting of exposing said surface to luminous radiation whose energy is at least equal to that of the gap of said semiconductor. For more details of this particular application, reference may be made to patent application FR 2 921 516.

Everything described above for solution $S_1$, namely the solvent, the amounts of adhesion primers and of other components, preparation of the adhesion primer in situ, the presence of a supporting electrolyte and optionally of a surfactant, also applies to solution $S_2$.

However, it should be pointed out that the solvent of solution $S_2$ is advantageously a protic solvent as defined above.

According to the invention, it is preferable for the electric potential used in step ($b_2$) of the method according to the present invention to be close to the reduction potential of the adhesion primer employed and which reacts at the surface. Thus, the value of the electric potential applied can be up to 50% higher than the reduction potential of the adhesion primer, more typically it will not be greater than 30%.

This variant of the present invention can be applied in an electrolysis cell having various electrodes: a first working electrode constituting the surface intended to receive the film, a counterelectrode and optionally a reference electrode.

The polarization of said surface can be effected by any technique known by a person skilled in the art and especially under linear or cyclic voltammetry conditions, potentiostatic, potentiodynamic, intensiostatic, galvanostatic or galvanodynamic conditions or by simple or pulsed chronoamperometry. Advantageously, the process according to the present invention is performed under static or pulsed chronoamperometric conditions. In static mode, the electrode is polarized for a duration generally of less than 2 h and typically less than 1 h, for example less than 20 min. In pulsed mode, the number of pulses will preferably be between 1 and 1000 and even more preferably between 1 and 100, their duration generally being between 100 ms and 5 s, typically 1 s.

The thickness of the organic film is easily controllable, whichever variant of the method of the present invention is employed, as explained above. For each of the parameters such as the duration of step ($b_1$) or ($b_2$) and as a function of the reagents that will be used, a person skilled in the art will be able to determine, by iteration, the optimum conditions for obtaining a film, of given thickness, without altering the optical properties of the surface.

Advantageously, the method according to the present invention comprises an additional step, prior to chemical grafting or electrografting, of cleaning the surface on which the organic film is to be formed, notably by buffing and/or polishing. A treatment additional to ultrasounds with an organic solvent such as ethanol, acetone or dimethylformamide (DMF) is even recommended.

Moreover, the method according to the present invention comprises an additional step, following chemical grafting or electrografting, consisting of submitting the grafted organic film to a thermal treatment. Advantageously, said thermal treatment consists of submitting said grafted film to a temperature between 60 and 180° C., notably between 90 and 150° C. and, in particular, of the order of 120° C. (i.e. 120° C.±10° C.) for a duration between 1 h and 3 days, notably between 6 h and 2 days and, in particular, between 12 and 24 h. This step of thermal treatment can be applied in a stove or in a furnace.

The present invention also relates to the use of a method as defined above for modifying the wettability of a surface, for improving the sealing (imperviousness) of a surface or for protecting said surface against corrosion. Thus, the present invention relates to a method for modifying the wettability of a surface, for improving the sealing of a surface and/or for protecting a surface against corrosion, said method consisting of modifying the surface energy of said surface by a method as defined above.

Finally the present invention relates to the use of a kit of components for modifying the surface energy of a surface, said kit comprising:

- in a first compartment, at least one adhesion primer, notably as defined above;
- optionally, in a second compartment, a component selected from the group comprising a fluorinated adhesion primer, a fluorinated (meth)acrylate and a vinyl-terminated siloxane, notably as defined above;
- optionally, in a third compartment, a chemical polymerization initiator, notably as defined above;
- and optionally, in a fourth compartment, electrical means for generating a potential.

In the kit according to the present invention, the adhesion primer in the first compartment and the component in the second compartment can be in solution. Said solutions are more particularly solutions $S_1$ and $S_2$ as defined above. The chemical initiator in the third compartment can also be in solution. Advantageously, a solvent, which may be identical or different, is contained in each of the solutions in the first and second compartments and optionally in the solution in the third compartment.

In a variant of the kit according to the invention, the first compartment does not contain an adhesion primer advantageously in solution but at least one precursor of an adhesion primer advantageously in solution. "Precursor of adhesion primer" is to be understood to mean a molecule separated from the primer by a single operational step that is easy to apply. In this case, the kit will optionally comprise at least one other compartment in which there will be at least one component necessary for preparing the primer from its precursor. Thus, the kit can for example contain an arylamine, precursor of the adhesion primer, advantageously in solution, as well as a solution of $NaNO_2$ to permit, by addition, the formation of an aryldiazonium salt, the adhesion primer. A person skilled in the art will have understood that the use of a precursor makes it possible to avoid storing or transporting reactive chemical species.

The solutions in the various compartments can of course contain various other agents, which may be identical or different, such as stabilizers or surfactants. The kit is simple to use, since all that is required is to place the sample whose surface is to be treated in contact with the mixture of solutions prepared extemporaneously by mixing the solutions from the different compartments, preferably with stirring and notably using ultrasounds. Advantageously, only the solution containing the monomer, i.e. from the second compartment, undergoes ultrasounds before being mixed with the solution containing the adhesion primer prepared extemporaneously from a precursor or present in the first compartment.

DETAILED DESCRIPTION OF CERTAIN EMBODIMENTS

EXAMPLE I

Grafting of the 4-NBDT/PHFBM Pair on Gold and Glass with Ferrocene

I.1. Reagents

The reagents used in example I are:

4-NBDT: F.W.=236.92; m=0.099 g; n=0.42 mmol; 1 eq.

DMF: v=3 mL.

THF: v=60 mL.

HFBM: F.W.=268.13; d=1.345; 97%, v=0.5 mL; n=2.4 mmol.

Ferrocene: F.W.=186.034; 97%, m 0.1 g; n=0.5 mmol; 1 eq.

I.2. Protocol

The glass plates were rinsed beforehand with water, ethanol and acetone using ultrasounds.

In a 100-mL beaker, 4-NBDT (99 mg, 4.2 $10^{-4}$ mol) was solubilized in a 20:1 mixture of THF/DMF (60 mL) with magnetic stirring at room temperature. HFBM (0.5 mL, 2.4 $10^{-3}$ mol) in 10 mL of THF was added to this yellow solution. Two glass plates, and two gold plates used as reference for verifying the effectiveness of grafting by IR, were then immersed in the bath. A solution of ferrocene (100 mg, 5 $10^{-4}$ mol) in THF (10 mL) was added (bath color greenish-black). A glass plate and a gold plate were withdrawn respectively after 30 and 60 min and then rinsed successively with MQ water, ethanol, and acetone and immersed in a bath of THF at 60° C. for 15 min before beginning the IR analyses.

I.3. Results

Figure 1:
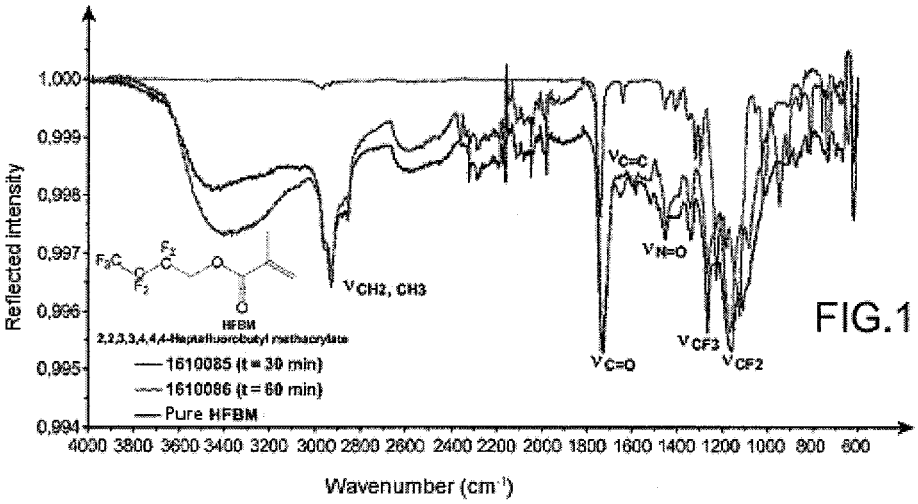
FIG. 1 presents the analysis by IR spectrometry of gold plates on which a film of 4-nitrobenzene diazonium tetrafluoroborate (4-NBDT) and of hexafluorobutylmethacrylate (HFBM) was grafted, by radical chemical grafting, for 30 min or 60 min, using ferrocene as chemical initiator, with a gold plate dipped in a solution of HFBM serving as control (pure HFBM).

Analysis of the gold plates by IR spectrometry confirms the presence of the expected film, the thickness of which is constant for the samples immersed for 30 and 60 min (FIG. 1). The specific bands of the copolymer at 1724 $cm^{-1}$ (C═O deformation), 1452 $cm^{-1}$ (N═O deformation), 1263 $cm^{-1}$ ($CF_3$ deformation), 1155 $cm^{-1}$ ($CF_2$ deformation) can be seen. The coating thicknesses (% grafting) are found by measuring the percentage absorption of the most intense band of the spectrum, here C═O.

Files:

1610085 (t=30 min, gold) 0.4% grafting

Figure 2:
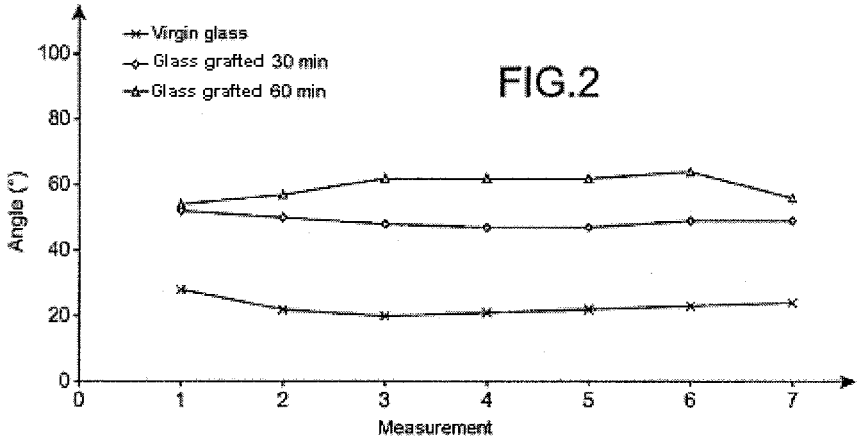
FIG. 2 shows the measured contact angle (7 independent measurements) for a drop of water on glass plates on which a film of 4-NBDT and HFBM was grafted, by radical chemical grafting, for 30 min or 60 min, using ferrocene as chemical initiator, with a plate of virgin glass serving as control.
Figure 3A:
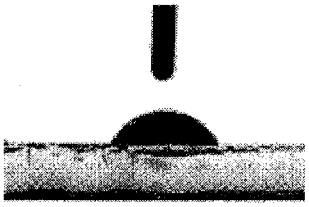
FIG. 3 shows a photograph of a drop of water on a glass plate on which a film of 4-NBDT and of HFBM was grafted, by radical chemical grafting (FIG. 3A) and a photograph of a drop of water on a plate of virgin glass (FIG. 3B).
Figure 3B:
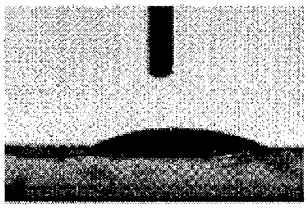

1610085' (t=30 min, glass) Not determined 1610086 (t=60 min, gold) 0.5% grafting 1610086' (t=60 min, glass) Not determined Table 1 below and FIG. 2 present the values of contact angle obtained for a drop of water placed on a plate of virgin glass or on a glass plate on which an organic film obtained from 4-NBDT and HFBM was grafted for 30 min or 60 min (7 independent measurements). FIG. 3 is a photograph of this drop on this grafted glass plate (FIG. 3A) or on a plate of virgin glass (FIG. 3B).

TABLE 1

| Measurement No. | Virgin glass θ(°) | Glass grafted 30 min θ(°) | Glass grafted 60 min θ(°) |
|---|---|---|---|
| 1 | 28 | 52 | 54 |
| 2 | 22 | 50 | 57 |
| 3 | 20 | 48 | 62 |
| 4 | 21 | 47 | 62 |
| 5 | 22 | 47 | 62 |
| 6 | 23 | 49 | 64 |
| 7 | 24 | 49 | 56 |

EXAMPLE II

Grafting of a Fluorinated Diazonium on Gold and Glass with Ferrocene

II.1. Reagents

The reagents used in example II are:

MB83, F.W.=570.07; m=0.055 g; n=9.6 $10^{-2}$ mmol; 1 eq.

acetonitrile: v=50 mL.

ferrocene: F.W.=186.034; 97%, m 0.1 g; n=0.52 mmol; 5.4 eq.

II.2. Protocol

In a 100-mL beaker, MB83 (55 mg, 9.6 $10^{-5}$ mol) was solubilized in acetonitrile (50 mL) with magnetic stirring at room temperature. To this yellow solution, two glass plates and two gold plates used as reference for verifying the thickness of the deposited film by IR were then immersed in the bath. A solution of ferrocene (100 mg, 5.2 $10^{-4}$ mol) in acetonitrile (10 mL) was added (dark red color of the bath). A glass plate previously treated with Piranha (2:1 mixture of $H_2SO_4$ and $H_2O_2$) and another of gold were withdrawn respectively after 30 and 60 min and then rinsed successively with MQ water, ethanol, and acetone and immersed in a bath of THF at 60° C. for 15 min. The samples also underwent ultrasound treatment in the bath of THF for 2-3 min before performing the IR analyses and measurements of contact angle.

II.3. Results

Figure 4:
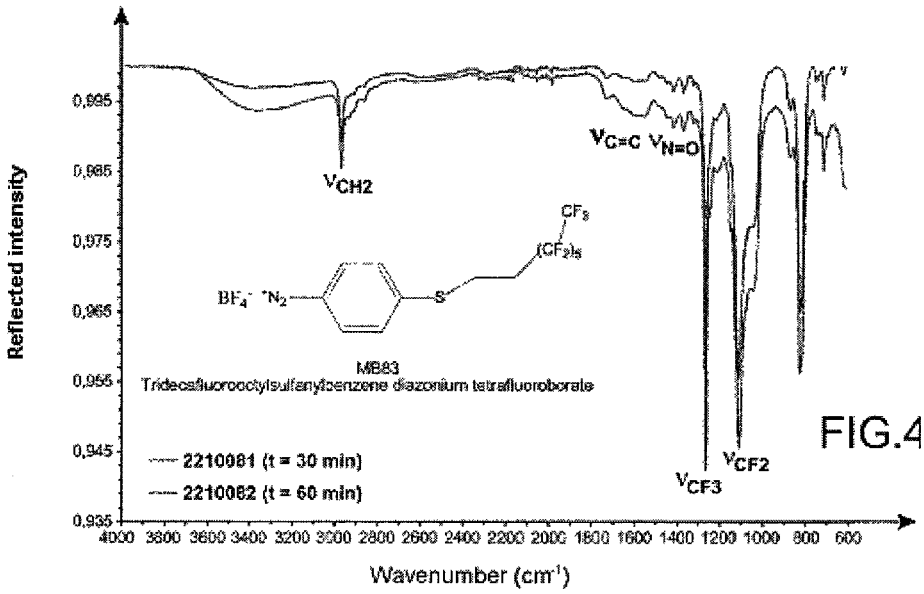
FIG. 4 presents the analysis by IR spectrometry of gold plates on which a film of tridecyl-fluorooctylsulfamylbenzene diazonium tetrafluoroborate (MB83) was grafted, by radical chemical grafting, for 30 min or 60 min, using ferrocene as chemical initiator.

Analysis of the gold plates by IR spectrometry confirms the presence of the expected film, the thickness of which is constant for the samples immersed for 30 and 60 min (FIG. 4). The specific bands of the coating at 1264 $cm^{-1}$ ($CF_3$ deformation), 1105 $cm^{-1}$ ($CF_2$ deformation) can be seen. The thicknesses (% grafting) of the coating are found by measuring the percentage absorption of the most intense band of the spectrum, here the $CF_3$ band at 1264 $cm^{-1}$.

Files:

2210081 (gold, 30 min) 4.0% grafting 2210082 (gold, 60 min) 5.1% grafting

2210081' (glass, 30 min) Not determined

2210082' (glass, 60 min) Not determined

Figure 5:
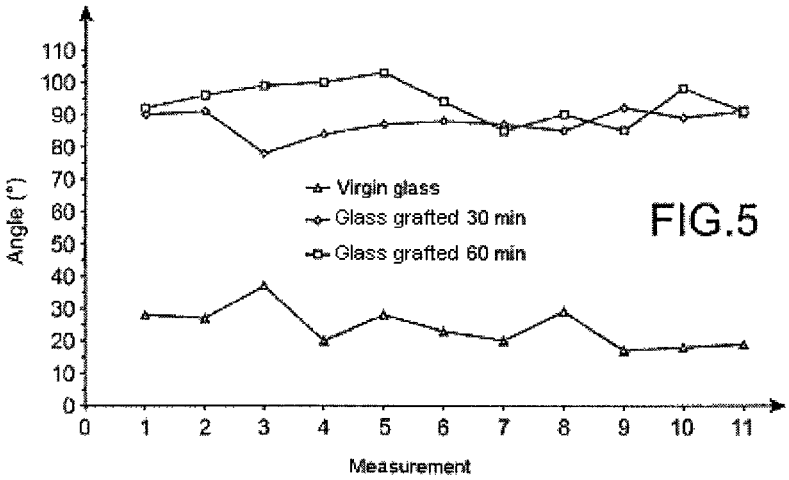
FIG. 5 shows the measured contact angle (11 independent measurements) for a drop of water on glass plates on which a film of MB83 was grafted, by radical chemical grafting, for 30 min or 60 min, using ferrocene as chemical initiator, with a plate of virgin glass serving as control.
Figure 6A:
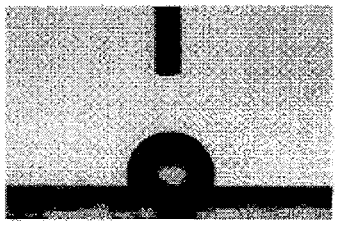
FIG. 6 shows a photograph of a drop of water on a glass plate on which a film of MB83 (FIG. 6A) was grafted, by radical chemical grafting, and a photograph of a drop of water on a plate of virgin glass (FIG. 6B).
Figure 6B:
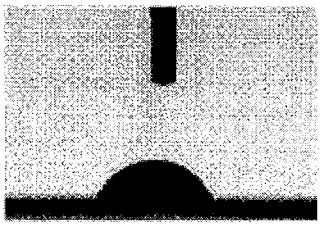

Table 2 below and FIG. 5 present the values of contact angle obtained for a drop of water placed on a plate of virgin glass or on a glass plate on which an organic film obtained from MB83 was grafted for 30 min or 60 min (11 independent measurements). FIG. 6 is a photograph of this drop on said grafted glass plate (FIG. 6A) or on a plate of virgin glass (FIG. 6B).

TABLE 2

| Measurement No. | Virgin glass θ(°) | Glass grafted 30 min θ(°) | Glass grafted 60 min θ(°) |
|---|---|---|---|
| 1 | 28 | 90 | 92 |
| 2 | 27 | 91 | 96 |
| 3 | 37 | 78 | 99 |
| 4 | 20 | 84 | 100 |
| 5 | 28 | 87 | 103 |
| 6 | 23 | 88 | 94 |
| 7 | 20 | 87 | 85 |
| 8 | 29 | 85 | 90 |
| 9 | 17 | 92 | 85 |
| 10 | 18 | 89 | 98 |
| 11 | 19 | 91 | 91 |

EXAMPLE III

Grafting of the 4-NBDT/PDMS Pair on Gold and Glass with Ferrocene

III.1. Reagents

The reagents used in example III are:

4-NBDT: F.W.=236.92; m=2.13 g; n=9 mmol; 1 eq.

acetonitrile: v=75 mL.

$CH_2Cl_2$ (DCM): v=75 mL.

PDMS F.W.=25000; d=0.965; 12.0 mL; n=0.46 mmol; 0.05 eq.

ferrocene: F.W.=186.034; 97%; m=1.0 g; n=5.2 mmol; 0.58 eq.

III.2. Protocol

In a 100-mL beaker, 4-NBDT (2.13 g, 9 $10^{-3}$ mol) was solubilized in acetonitrile (75 mL) with magnetic stirring at room temperature. PDMS (vinyl-terminated polydimethylsiloxane) (12.0 mL, 4.6 $10^{-4}$ mol) in 75 mL of dichloromethane was added to this yellow solution, forming a yellow emulsion. Two glass plates previously treated with Piranha and two gold plates used as reference for IR confirmation of the presence of the graft polymer were then immersed in the bath. A solution of ferrocene (1 g, 5.2 $10^{-3}$ mol) in DCM (20 mL) was added (greenish-black color of the bath). A batch of two plates of glass and of gold was withdrawn after 30 min and another at 60 min. These plates were rinsed successively with MQ water, ethanol, and acetone and immersed in a bath of hexane at 60° C. for 15 min. The samples also underwent ultrasound treatment in a bath of hexane for 2-3 min before performing the IR analyses and measurements of contact angle.

III.3. Results

Figure 7:
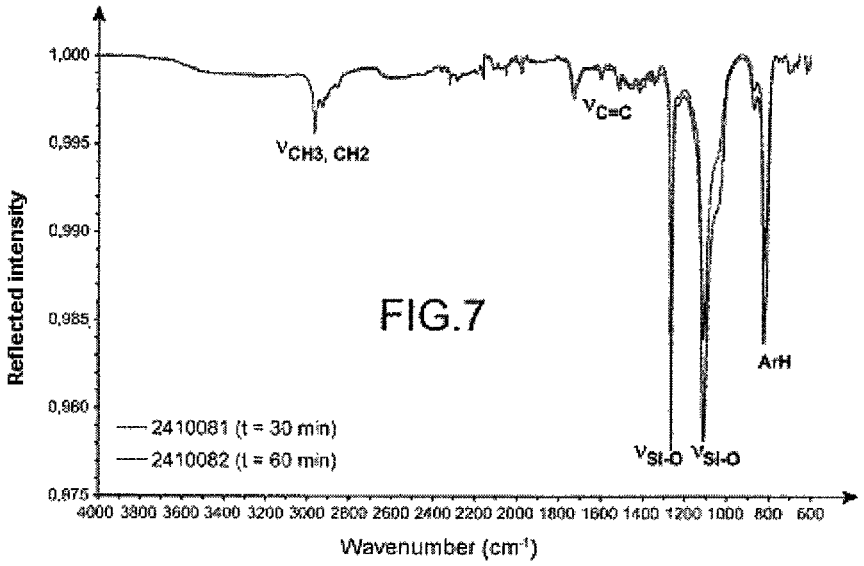
FIG. 7 presents the analysis by IR spectrometry of gold plates on which a film of 4-NBDT and of vinyl-terminated polydimethylsiloxane (PDMS) was grafted, by radical chemical grafting, for 30 min or 60 min, using ferrocene as chemical initiator.

Analysis of the gold plates by IR spectrometry confirms the presence of the expected film, the thickness of which increases as a function of time (FIG. 7). The specific bands of the coating at 1264 $cm^{-1}$ (Si—O deformation), 1107 $cm^{-1}$ (Si—O deformation) can be seen. The thicknesses (% grafting) of the coating were found by measuring the percentage absorption of the most intense band of the spectrum, here Si—O at 1264 $cm^{-1}$.

Files:

2410081 (t=30 min, gold) 1.0% grafting 2410082 (t=60 min, gold) 5% grafting

2410081' (t=30 min, glass) Not determined

2410082' (t=60 min, glass) Not determined

Figure 8:
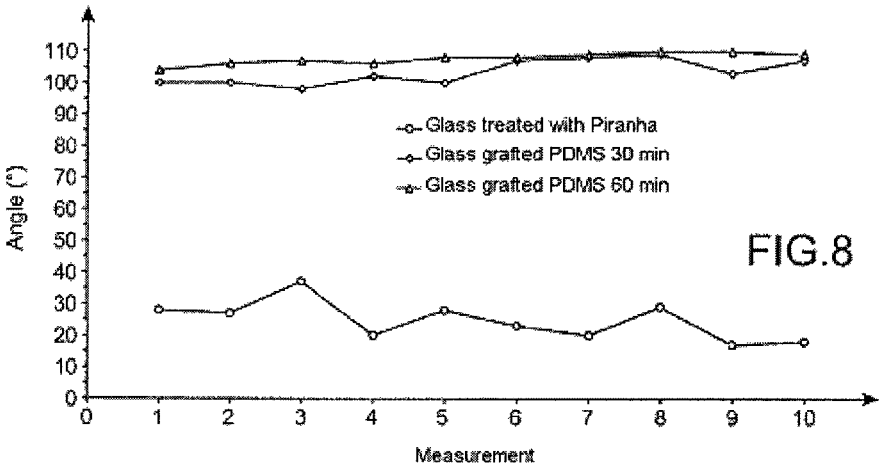
FIG. 8 shows the measured contact angle (10 independent measurements) for a drop of water on glass plates on which a film of 4-NBDT and of PDMS was grafted, by radical chemical grafting, for 30 min or 60 min, using ferrocene as chemical initiator, with a plate of virgin glass serving as control.
Figure 9A:
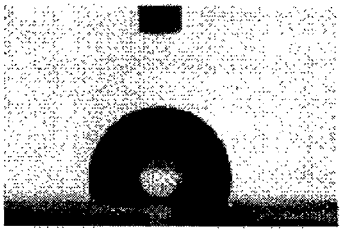
FIG. 9 shows a photograph of a drop of water on a glass plate on which a film of 4-NBDT and of PDMS was grafted, by radical chemical grafting (FIG. 9A) and a photograph of a drop of water on a plate of virgin glass (FIG. 9B).
Figure 9B:
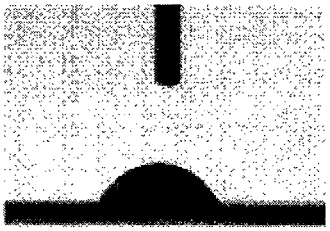

Table 3 below and FIG. 8 present the values of contact angle obtained for a drop of water placed on a plate of virgin glass or on a glass plate on which an organic film obtained from 4-NBDT and PDMS was grafted for 30 min or 60 min (10 independent measurements). FIG. 9 is a photograph of this drop on said grafted glass plate (FIG. 9A) or on a plate of virgin glass (FIG. 9B).

TABLE 3

| Measurement No. | Virgin glass θ(°) | Glass grafted 30 min θ(°) | Glass grafted 60 min θ(°) |
|---|---|---|---|
| 1 | 28 | 100 | 104 |
| 2 | 27 | 100 | 106 |
| 3 | 37 | 98 | 107 |
| 4 | 20 | 102 | 106 |
| 5 | 28 | 100 | 108 |
| 6 | 23 | 107 | 108 |
| 7 | 20 | 108 | 109 |
| 8 | 29 | 109 | 110 |
| 9 | 17 | 103 | 110 |
| 10 | 18 | 107 | 109 |

The samples of glass treated for 60 minutes were annealed in a stove at 120° C. for 18 h. This treatment gives a 10° increase in the average value of the contact angle.

EXAMPLE IV

Grafting of vinylPDMS (Vinylpolydimethylsiloxane) in Emulsion on Glass Plates 20 ml of deionized water and 0.092 g ($1.2\times10^{-2}$ M) of sodium dodecylbenzene sulfonate (SDBS) were poured into a beaker equipped with a magnetic stirring bar. After vigorous stirring for 10 min, 1.4 ml of vinylPDMS (MW ~25 000) was introduced and stirring was continued for 10 min. Then 0.075 g of NBDT (nitrobenzene diazonium tetrafluoroborate, $1.48\times10^{-2}$ M) was added to the mixture. The plates to be treated (microscope slides) were then immersed in the solution for a duration of 60 min. Finally, 0.1 ml of a freshly prepared solution of ascorbic acid at $10^{-2}$M, i.e. $1.35\times10^{-3}$ M, was added to the reaction mixture.

Figure 10:
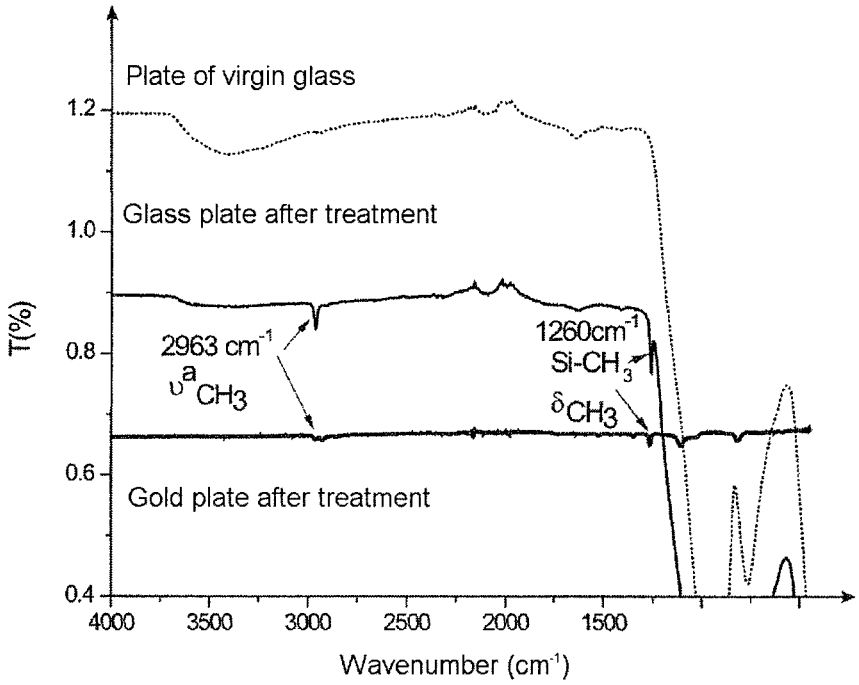
FIG. 10 presents the analysis by IR spectrometry of glass plates and gold plates on which a film of NBDT and of vinylpolydimethylsiloxane (vinylPDMS) was grafted, by radical chemical grafting in emulsion, with a plate of virgin glass serving as control.

FTIR spectrum analysis, performed after ultrasound treatment of the plate for 2 min in toluene (a good solvent of PDMS), reveals the presence of PDMS (Si—$CH_3$ band at 2963 $cm^{-1}$ and at 1260 $cm^{-1}$). The spectrum was compared with that obtained with a gold plate treated identically and with the spectrum of a plate of virgin glass (FIG. 10).

The values of the contact angles of a plate of virgin glass, of a glass plate treated according to the protocol described above and of a gold plate which underwent the same treatment are 28.7±4.4, 100±4.6 and 96.8±3.8 respectively.

EXAMPLE V

Grafting of vinylPDMS in Emulsion in the Presence of SDS or SDBS on Gold Plates and Glass Plates 20 ml of deionized water and 0.050 g (i.e. 1.3 $10^{-2}$ M) of SDS were poured into a beaker equipped with a magnetic stirring bar. After vigorous stirring for 10 min, 1.4 ml of vinyl-PDMS (Mw~25 000) was introduced and stirring was continued for 10 min. Then 0.075 g of NBDT (1.48 $10^{-2}$ M) was added to the reaction mixture. The gold or glass plates to be treated were then immersed in the solution for 60 minutes. Finally, 0.2 ml of a freshly prepared solution of ascorbic acid at 0.3 M, i.e. 2.7 $10^{-3}$ M, was added to the reaction mixture.

Figure 11:
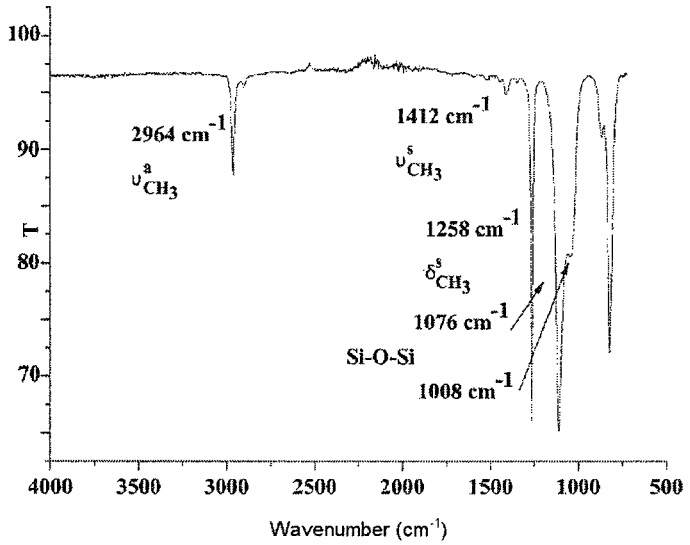
FIG. 11 presents the analysis by IR spectrometry of a film of PDMS grafted on a gold plate by radical chemical grafting applied with vinyl-PDMS in emulsion.

FTIR spectrum analysis, performed after ultrasound treatment of the gold plate for 2 min in toluene, revealed the presence of PDMS. The Si—$CH_3$ bands appear at 2962 $cm^{-1}$ (asymmetric elongation), at 1412 $cm^{-1}$ (symmetric elongation) and at 1260 $cm^{-1}$ (deformation) (FIG. 11). The presence of 2 intense elongation bands at 1080 and 1010 $cm^{-1}$ of the siloxane functions SiOSi is evidence of the use of a long-chain polymer.

Figure 12:
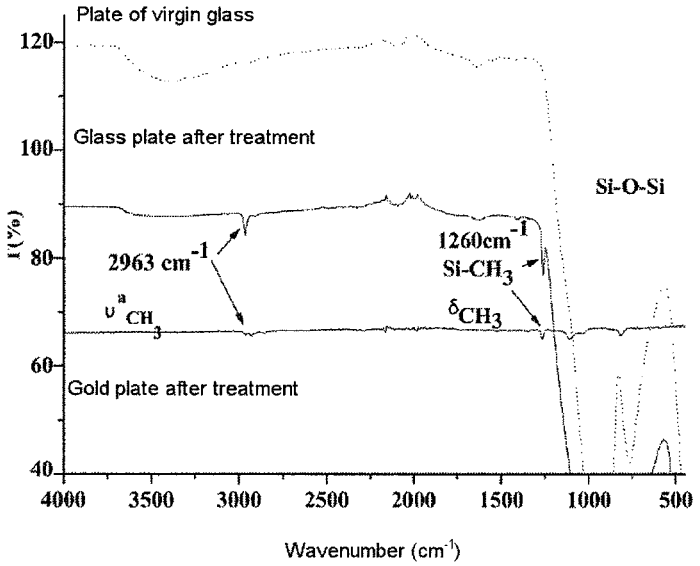
FIG. 12 presents the analysis by IR spectrometry of a film of PDMS grafted on a glass plate compared with that of a film of PDMS grafted on a gold plate.

On a glass plate, the FTIR spectrum has lower resolution owing to the presence of a very large Si—O—Si band, as can be seen in FIG. 12.

The values of the contact angles of a plate of virgin glass, of a glass plate treated according to the protocol described above and of a gold plate which underwent the same treatment are 28.7±4.4, 100±4.6 and 96.8±3.8 respectively.

Experiments were performed with SDS and SDBS, varying the amount of vinyl-PDMS in the reaction mixture and applying or not applying annealing for one hour at 120° C. on the samples before the ultrasound treatment in toluene. The results are presented in Table 4 below.

The amount of reagents and the experimental protocol, identical to that described above, are identical in all cases with the concentration of emulsifier of 1.25 $10^{-2}$ M, concentration of NBDT of 1.5 $10^{-2}$ M and concentration of ascorbic acid of 1.35 $10^{-2}$ M.

TABLE 4

| Emulsifier | Amount of PDMS (ml) | With or without annealing 120° C. 1 h | Contact angle On gold plate | Contact angle On glass plate |
|---|---|---|---|---|
| SDS | 0.6 | Without | 100.4 ± 3.6 | |
| | | With | 100.8 ± 7.2 | 102.3 ± 2 |
| " | 2.8 | Without | 101.8 ± 3.8<br>105.2 ± 2 | 69.9 ± 4.8 |
| | | With | 99.1 ± 3.2 | 100.5 ± 5.2 |
| SDBS | 0.6 | Without | Loss of the layer | 67.8 ± 3.2 |
| | | With | 105.6 ± 2.3 | 101.6 ± 2.2 |
| " | 2.8 | Without | 103.8 ± 4<br>104 ± 2.6 | 78.4 ± 7 |
| | | With | 96.8 ± 3.8<br>107.1 ± 1.4 | 100 ± 4.6<br>103.5 ± 2.9 |

It can be seen that, for both emulsifiers, comparable results are obtained using 0.6 or 2.8 ml of vinyl-PDMS. However, a larger amount of PDMS improves the hydrophobicity of the layer. In contrast, annealing seems to promote the formation of a more homogeneous layer, which improves the hydrophobicity.

What is claimed is:

1. A method for modifying the surface energy of at least one surface of a solid comprising a step consisting of:

grafting, on said surface, a polymeric organic film consisting of graft polymers, each polymer having a first unit bound directly to said surface derived from a cleavable aryl salt and at least one other unit derived from a vinyl-terminated siloxane, wherein said vinyl-terminated siloxane is a compound of formula (IV):

$$R3—[OSi(R4)(R5)]n—R6 \quad (IV)$$

in which n represents an integer between 2 and 200;

R3 and R6 are groups having at least one ethylenic unsaturation and

R4 and R5, which may be identical or different, represent a linear, branched or cyclic alkyl group, comprising from 1 to 6 carbon atoms.

2. The method as claimed in claim 1, wherein said cleavable aryl salt is selected from the group consisting of aryldiazonium salts, arylammonium salts, arylphosphonium salts, aryliodonium salts and arylsulfonium salts.

3. The method as claimed in claim 1, wherein said group $R_3$ represents a group —C(O)—$R_7$ and/or said group $R_6$ represents a group —O—C(O)—$R_8$ in which $R_7$ and $R_8$, which may be identical or different, represent a group comprising 2 to 12 carbon atoms and having at least one ethylenic unsaturation.

4. The method as claimed in claim 3, wherein $R_7$ and $R_8$, which may be identical or different, correspond to groups of formula (V):

$$C(R_9)(R_{10})=C(R_{11})— \quad (V)$$

in which $R_9$, $R_{10}$ and $R_{11}$, which may be identical or different, represent a hydrogen atom or a linear, branched or cyclic alkyl group, comprising from 1 to 4 carbon atoms.

5. The method as claimed in claim 4, wherein $R_9$, $R_{10}$ and $R_{11}$, which may be identical or different, represent a hydrogen atom or a linear, branched or cyclic alkyl group, comprising from 1 or 2 carbon atoms.

6. The method as claimed in claim 1, wherein said grafting is a chemical grafting.

7. The method as claimed in claim 6, wherein said method comprises the steps consisting in:

$a_1$) contacting said surface with a solution $S_1$ comprising at least one cleavable aryl salt and at least one vinyl-terminated siloxane, wherein said vinyl-terminated siloxane is a compound of formula (IV):

$$R3—[OSi(R4)(R5)]n—R6 \quad (IV)$$

in which n represents an integer between 2 and 200;

R3 and R6 are groups having at least one ethylenic unsaturation and

R4 and R5, which may be identical or different, represent a linear, branched or cyclic alkyl group, comprising from 1 to 6 carbon atoms;

$b_1$) submitting said solution $S_1$ to nonelectrochemical conditions permitting formation of radical entities from said cleavable aryl salt.

8. The method as claimed in claim 7, wherein said surface is a glass surface.

9. The method as claimed in claim 8, wherein said glass surface comprises a surface of a flat glass, a surface of an aquarium glass, a surface of a glass for mechanical optics or a surface of an optical glass.

10. The method as claimed in claim 9, wherein said flat glass comprises a glass used in building, architecture, automobiles, glazing and a mirror industry.

11. The method as claimed in claim 1, wherein said grafting is an electrografting.

12. The method as claimed in claim 11, wherein said method comprises the steps consisting in:

$a_2$) contacting a conducting or semiconducting surface with a solution $S_2$ comprising at least one cleavable aryl salt and at least vinyl-terminated siloxane, wherein said vinyl-terminated siloxane is a compound of formula (IV):

$$R3—[OSi(R4)(R5)]n—R6 \quad (IV)$$

in which n represents an integer between 2 and 200;

R3 and R6 are groups having at least one ethylenic unsaturation and

R4 and R5, which may be identical or different, represent a linear, branched or cyclic alkyl group, comprising from 1 to 6 carbon atoms;

$b_2$) polarizing said surface at an electric potential that is more cathodic than a reduction potential of the cleavable aryl salt employed in step ($a_2$), with steps ($a_2$) and ($b_2$) being in any order.

13. The method as claimed in claim 1, wherein said method comprises an additional step, prior to said grafting, of cleaning said surface.

14. The method as claimed in claim 1, wherein said method comprises an additional step, following said grafting, consisting of submitting the grafted organic film to a thermal treatment.

15. A method for modifying the wettability of a surface, for improving the sealing of a surface and/or for protecting a surface against corrosion, said method consisting of modifying surface energy of said surface by a method as defined in claim 1.

16. The method as claimed in claim 1, wherein n represents an integer between 5 and 150.

17. The method as claimed in claim 1, wherein n represents an integer between 10 and 100.

18. The method as claimed in claim 1, wherein $R_4$ and $R_5$, which may be identical or different, represent a linear, branched or cyclic alkyl group, comprising from 1 to 3 carbon atoms.

* * * * *